US009311863B2

(12) United States Patent
Chen et al.

(10) Patent No.: US 9,311,863 B2
(45) Date of Patent: Apr. 12, 2016

(54) DIMMING METHOD AND DIMMING DEVICE FOR BACKLIGHT MODULE

(71) Applicant: Novatek Microelectronics Corp., Hsinchu (TW)

(72) Inventors: Hsing-Chuan Chen, Taichung (TW); Wen-Chi Lin, Yilan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 133 days.

(21) Appl. No.: 14/078,553

(22) Filed: Nov. 13, 2013

(65) Prior Publication Data

US 2015/0009114 A1 Jan. 8, 2015

(30) Foreign Application Priority Data

Jul. 2, 2013 (TW) ..... 10213697 A

(51) Int. Cl.
*G09G 3/34* (2006.01)
*G09G 3/36* (2006.01)

(52) U.S. Cl.
CPC ..... *G09G 3/342* (2013.01); *G09G 3/3406* (2013.01); *G09G 3/3648* (2013.01); *G09G 2320/0646* (2013.01); *G09G 2360/16* (2013.01)

(58) Field of Classification Search
CPC ..... G09G 3/3406; G09G 3/3648
USPC ..... 345/102
See application file for complete search history.

(56) References Cited

U.S. PATENT DOCUMENTS

| | | | | |
|---|---|---|---|---|
| 8,451,300 | B2 | 5/2013 | Hsu et al. | |
| 8,643,593 | B2 | 2/2014 | Chang et al. | |
| 2006/0214904 | A1* | 9/2006 | Kimura et al. | 345/102 |
| 2007/0002000 | A1* | 1/2007 | Kwon | 345/102 |
| 2007/0296689 | A1* | 12/2007 | Kimura et al. | 345/102 |
| 2008/0238856 | A1 | 10/2008 | Bhowmik et al. | |
| 2011/0141004 | A1* | 6/2011 | Kwon et al. | 345/102 |
| 2011/0157255 | A1 | 6/2011 | Hsu et al. | |
| 2013/0016141 | A1 | 1/2013 | Chang et al. | |

FOREIGN PATENT DOCUMENTS

| | | |
|---|---|---|
| TW | 201033981 | 9/2010 |
| TW | 201123158 | 7/2011 |
| TW | 201211985 | 3/2012 |
| TW | 201303833 | 1/2013 |

OTHER PUBLICATIONS

"Notice of Allowance of Taiwan Counterpart Application", issued on Oct. 28, 2015, p. 1-p. 3.

* cited by examiner

*Primary Examiner* — Chanh Nguyen
*Assistant Examiner* — Daniel Duong
(74) *Attorney, Agent, or Firm* — Jianq Chyun IP Office

(57) ABSTRACT

A dimming method and dimming device for a backlight module are provided. The dimming method includes the following steps. Light distribution information of a plurality of light sources of the backlight module corresponding to a display panel is provided. According to the light distribution information of each of the light sources, a plurality of light contribution ratios of the light sources corresponding to a plurality of different positions of the display panel are obtained respectively. According to the light contribution ratios corresponding to the different positions, the needed intensity of each of the light sources is determined respectively.

38 Claims, 4 Drawing Sheets

DIMMING METHOD AND DIMMING DEVICE FOR BACKLIGHT MODULE

CROSS-REFERENCE TO RELATED APPLICATION

This application claims the priority benefit of Taiwan application serial no. 102123697, filed on Jul. 2, 2013. The entirety of the above-mentioned patent application is hereby incorporated by reference herein and made a part of this specification.

FIELD OF THE INVENTION

The invention relates to dimming technique of a backlight module, and more particularly to a dimming method and a dimming device for a backlight module of a display panel.

DESCRIPTION OF RELATED ART

Due to rapid advancement of technologies, portable electronics and flat panel displays have gained popularity. Among various types of flat panel displays, liquid crystal displays (LCDs) have gradually become the mainstream display products due to advantages such as low operating voltage, lack of harmful radiation, light weight and small and compact size. The LCD is formed mainly by the backlight module and the display panel, and since the display panel cannot emit light by itself, the backlight module is used to provide the backlight source needed by LCD for image display. Based on light incident method, the backlight module may be categorized into two types, the direct-type backlight module and the edge-type backlight module.

Moreover, while the display quality of the LCD increases with user demand, the backlight module is no longer solely used as the light source. In order to enhance the efficiency of the display device, the brightness of the backlight module is adjusted in accordance with different display conditions and power consumption. FIG. 1 is a schematic view of a conventional LCD. In conventional local dimming techniques, the display panel of the LCD may be divided into a plurality of zones by different methods. As shown in FIG. 1, a LCD 10 has a display panel 110 and a backlight module 111, and the display panel 110 is divided into 4 display zones Zone_1-Zone_4. A plurality of backlight sources 111_1-111_4 respectively correspond to the display zones Zone_1-Zone_4, and according to the image contents of each corresponding zone, the brightness of the backlight provided is adjusted.

In the embodiment detailed in FIG. 1, the display zone Zone_1 corresponds to the backlight source 111_1, and by analogy, the display zone Zone_4 corresponds to the backlight source 111_4. Therefore, the backlight source 111_1 may adjust the brightness according to the needed brightness of the corresponding display zone Zone_1. By analogy, the backlight source 111_4 may adjust the brightness according to the needed brightness of the corresponding display zone Zone_4, thereby enhancing the contrast ratio of the display frame. In conventional dimming methods, the backlight source 111_1 adjusts the brightness by only considering the needed brightness of the pixels in the display zone Zone_1, without considering pixels of other zones. By analogy, the backlight source 111_4 adjusts the brightness by only considering the needed brightness of the pixels in the display zone Zone_4, without considering pixels of other zones. However, due to the principle of edge-type backlight source providing a light source through the light guide plate, besides the light provided to the pixels in each respective zone, the provided light may also affect the pixels in other non-corresponding display zones. The provided light may be expanded on the display panel into different illumination zones. In other words, the brightness of each display zone may be provided by multiple sets of edge-type backlight sources. Accordingly, with regards to the conventional local dimming techniques, since zone calculation methods cannot take into account the light source contribution of other farther away regions, issues such as insufficient brightness of a certain part of the display zones or inadequate display quality of the LCD may easily occur.

SUMMARY OF THE INVENTION

Accordingly, the invention provides a dimming method and dimming device for a backlight module, in which according to the light distribution information of a plurality of light sources corresponding to the display panel, the needed intensity of each of the light sources is determined, thereby enhancing the display quality of the LCD.

The invention provides a dimming method for a backlight module, in which the dimming method includes the following steps. Provide a light distribution information of a plurality of light sources of the backlight module corresponding to a display panel. According to the light distribution information of each of the light sources, respectively obtain a plurality of light contribution ratios of the light sources corresponding to a plurality of different positions of the display panel. According to the light contribution ratios corresponding to the different positions, respectively determine a needed intensity of each of the light sources.

According to an embodiment of the invention, in the dimming method for the backlight module, the light distribution information of each of the light sources includes a brightness value contributed by the light source at each of a plurality of pixels of the display panel.

According to an embodiment of the invention, in the dimming method for the backlight module, the different positions of the display panel include each of the pixels of the display panel.

According to an embodiment of the invention, in the dimming method for the backlight module, the step of respectively obtaining the light contribution ratios of the light sources includes: for each pixel, respectively obtaining the light contribution ratio of at least two selected light sources corresponding to the pixel in the light sources.

According to an embodiment of the invention, in the dimming method for the backlight module, the at least two selected light sources corresponding to the pixel include all of the light sources.

According to an embodiment of the invention, in the dimming method for the backlight module, the at least two selected light sources corresponding to the pixel include at least two light sources nearest to the pixel in the plurality of the light sources.

According to an embodiment of the invention, in the dimming method for the backlight module, the display module is divided into a plurality of regions respectively corresponding to the plurality of light sources, and the at least two selected light sources corresponding to the pixel include a light source corresponding to a region where the pixel is located, and at least one light source corresponding to at least one region adjacent to the region where the pixel is located.

According to an embodiment of the invention, in the dimming method for the backlight module, the step of according to the light distribution information of each of the light sources, respectively obtaining the light contribution ratios of the light sources corresponding to the different positions of the display panel includes: respectively performing the following steps at each of the different positions of the display panel: according to the light distribution information of the light sources, respectively obtaining a plurality of brightness values of the light sources; according to the brightness values of the light sources obtained at the position, obtaining a total brightness value at the position; and obtaining the light contribution ratios of the light sources at the position by respectively calculating each ratio of the brightness values of the light sources at the position and the total brightness value to serve as a light contribution ratio value of each of the light sources at the position.

According to an embodiment of the invention, in the dimming method for the backlight module, the step of according to the light contribution ratios corresponding to the pixels of the display panel, determining the intensity of the light sources includes: (i) for each of the different positions of the display panel and while satisfying a target brightness value of the position, respectively obtaining a possible needed intensity of the at least two selected light sources according to the light contribution ratio obtained at the position. (ii) For each of the light sources, determining the needed intensity of the light source according to the possible needed intensities of the light source respectively obtained for the different positions.

According to an embodiment of the invention, the dimming method for the backlight module further includes: for each of the pixels, converting a pixel data of the pixel into the target brightness value of the pixel.

According to an embodiment of the invention, in the dimming method for the backlight module, the step of converting the pixel data of the pixel into the target brightness value is implemented by using a GAMMA curve.

According to an embodiment of the invention, in the dimming method for the backlight module, the step of converting the pixel data of the pixel into the target brightness value includes: calculating $k=DP/DM$, in which k is the target brightness value of the pixel, DP is the pixel data of the pixel, and DM is a maximum value of a range of the pixel data.

According to an embodiment of the invention, in the dimming method for the backlight module, the step of respectively obtaining the possible needed intensity of the at least two selected light sources according to the light contribution ratio obtained at the position includes: arranging the target brightness value to be equal to a sum of a product corresponding to the possible needed brightness of the at least two selected light sources at the position and each light contribution ratio value, so as to calculate the possible needed brightness of the at least two selected light sources at the position.

According to an embodiment of the invention, in the dimming method for the backlight module, the step (i) further includes: for each of the different positions of the display panel, arranging the possible needed intensities of the at least two selected light sources to be equal.

According to an embodiment of the invention, in the dimming method for the backlight module, the step (i) further includes: for each of the different positions of the display panel, arranging to 0 the possible needed intensity of the selected light source in the at least two selected light sources having a brightness contribution ratio value less than a threshold value, and arranging the possible needed intensities of the other selected light sources in the at least two selected light sources to be equal.

According to an embodiment of the invention, in the dimming method for the backlight module, the step (i) further includes: for each of the different positions of the display panel, determining a ratio of the possible needed intensities of the at least two selected light sources according to the light contribution ratio of the at least two selected light sources.

According to an embodiment of the invention, in the dimming method for the backlight module, the step of determining the ratio of the possible needed intensities of the at least two selected light sources according to the light contribution ratio of the at least two selected light sources includes: determining the ratio of the possible needed intensities of the at least two selected light sources to be equal to the light contribution ratio of the at least two selected light sources.

According to an embodiment of the invention, in the dimming method for the backlight module, the step (ii) of determining the brightness of the light sources includes: for each of the light sources, determining a maximum of the possible needed intensities of the light source respectively obtained for the different positions to serve as the needed intensity of the light source.

The invention provides a dimming method for a backlight module, in which the dimming method includes the following steps. Provide a light distribution information of a plurality of light sources of the backlight module corresponding to a display panel. At each of a plurality of pixels of the display panel, respectively obtain a light contribution ratio of at least two selected light sources in the plurality of light sources according to the light distribution information of the at least two selected light sources corresponding to the pixel. For each of the different positions of the display panel and while satisfying a target brightness value of the position, respectively obtain a possible needed intensity of the at least two selected light sources according to the light contribution ratio obtained at the position. For each of the light sources, determine a needed intensity of the light source according to the possible needed intensities of the light source respectively obtained for the different positions.

From another perspective, the invention provides a dimming device for a backlight module, the dimming device including a database and a dimming circuit. The database provides a light distribution information of a plurality of light sources of the backlight module corresponding to a display panel. The dimming circuit is coupled to the database. According to the light distribution information of each of the light sources, the dimming circuit respectively obtains a plurality of light contribution ratios of the light sources corresponding to a plurality of different positions of the display panel. Moreover, according to the light contribution ratios corresponding to the different positions, the dimming circuit respectively determines a needed intensity of each of the light sources.

From another perspective, the invention provides a dimming device for a backlight module, the dimming device including a database and a dimming circuit. The database provides a light distribution information of a plurality of light sources of the backlight module corresponding to a display panel. The dimming circuit is coupled to the database. At each of a plurality of pixels of the display panel, the dimming circuit respectively obtains a light contribution ratio of at least two selected light sources in the plurality of light sources according to the light distribution information of the at least two selected light sources corresponding to the pixel. For each of the different positions of the display panel and while satisfying a target brightness value of the position, the dimming circuit respectively obtains a possible needed intensity of the at least two selected light sources according to the light contribution ratio obtained at the position. For each of the light sources, the dimming circuit determines a needed intensity of the light source according to the possible needed intensities of the light source respectively obtained for the different positions.

In summary, in the dimming methods and dimming devices according to embodiments of the invention, by respectively obtaining the light contribution ratios of each light source at different positions of the display panel according to the light distribution information of the light sources, the needed intensity of each light source is determined according to the light contribution ratios of each light source at the different positions. Accordingly, the brightness each light source need to emit is determined by directly considering the light distribution of the light sources on the display panel. Therefore, the dimming methods of the backlight sources are no longer limited to the zone dimming techniques, but rather the backlight sources are driven according directly to the actual backlight distribution, thereby ensuring all display regions of the display panel have sufficient backlight brightness.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
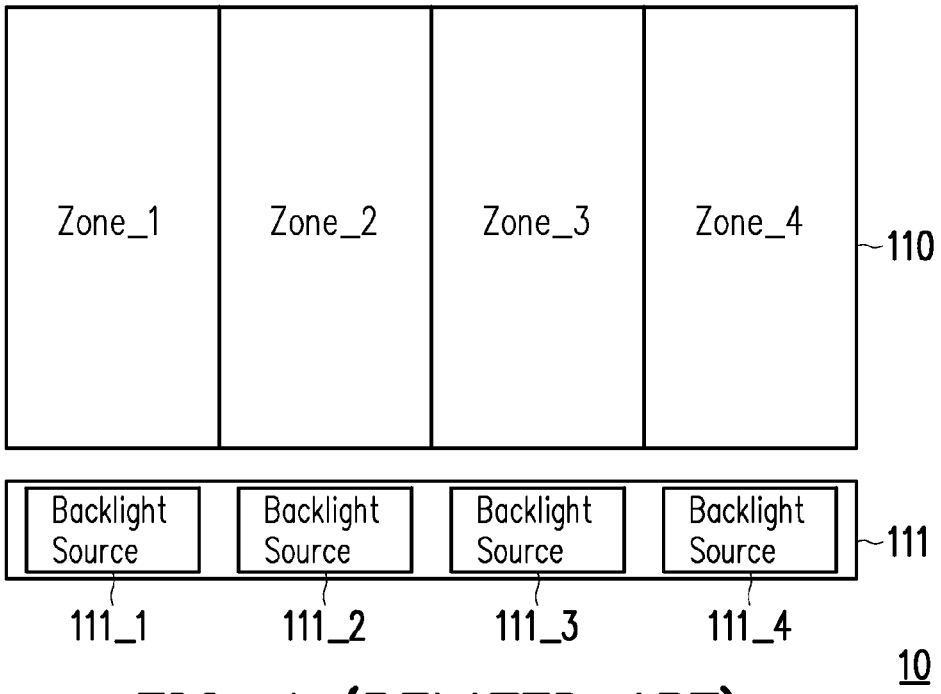
FIG. 1 (RELATED ART)
FIG. 1 is a schematic view of a conventional LCD.

The terms "connected," "coupled," and "mounted" and variations thereof herein (including the claims) are used broadly and encompass direct and indirect connections, couplings, and mountings. For example, if the disclosure describes a first apparatus being coupled to a second apparatus, then the first apparatus can be directly connected to the second apparatus, or the first apparatus can be indirectly connected to the second apparatus through other devices or by a certain coupling means. Moreover, elements/components/steps with the same reference numerals represent same or similar parts in the drawings and embodiments. Elements/components/notations with the same reference numerals in different embodiments may be referenced to the related description.

Figure 2:
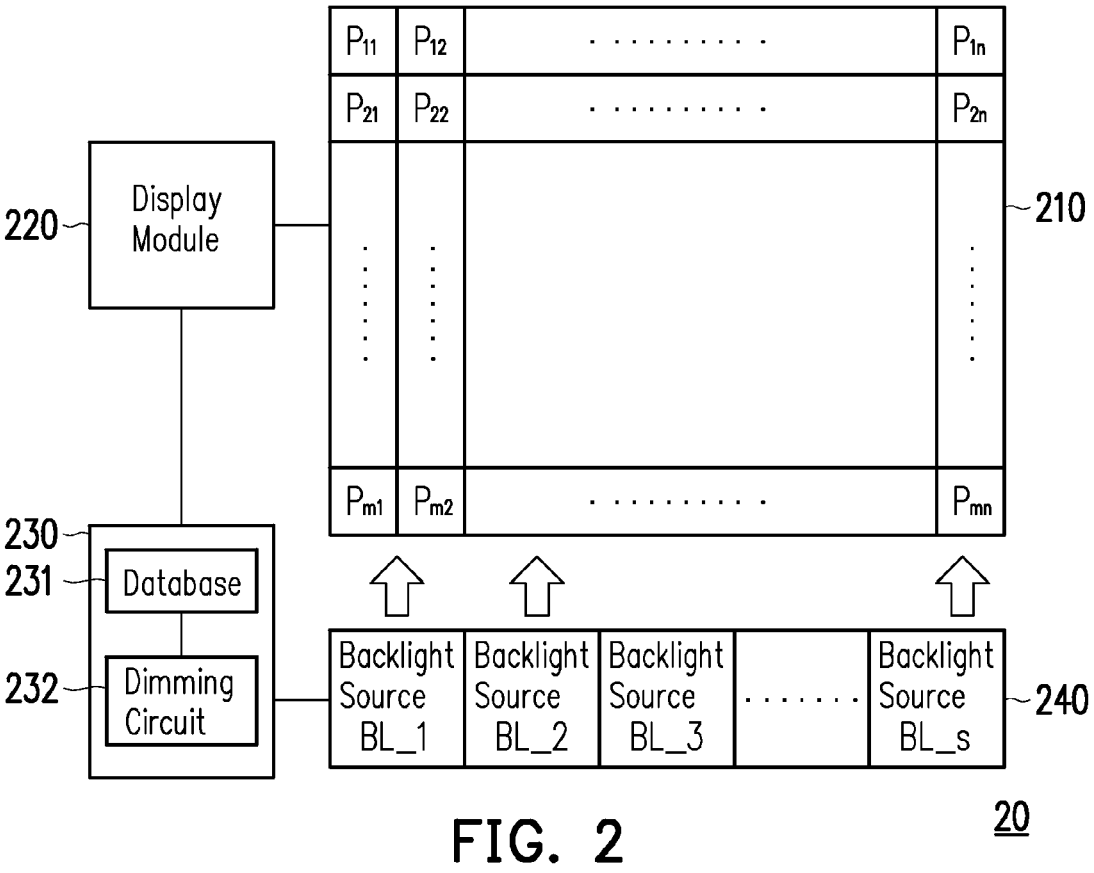
FIG. 2 is a system block diagram illustrating an LCD according to an embodiment of the invention.

FIG. 2 is a system block diagram illustrating a liquid crystal display (LCD) 20 according to an embodiment of the invention. With reference to FIG. 2, the LCD 20 includes a LCD panel 210, a display module 220, a dimming device 230, and a backlight module 240 providing a backlight source needed by the display panel 210. In some embodiments, the display module 220 includes a scalar, a timing controller, a source driver, and/or a gate driver, in which the display panel 220 drives the LCD panel 210 according to a pixel data of an image.

In the present exemplary embodiment, the display panel 210 has a plurality of pixels $P_{11}$ to $P_{mn}$ arranged in an array (m*n) to achieve the effect of image display with the light source provided by the backlight module 240. The backlight module 240 has s backlight sources BL_1-BL_s, and m, n, and s are positive integers. Typically speaking, m*n may also represent the display resolution of the LCD 20, such as 1024*768, although not limited thereto. The dimming device 230 includes a database 231 and a dimming circuit 232, and the database 231 is coupled to the dimming circuit 232. The database 231 is an element having a storage function for providing a light distribution information of a plurality of light sources BL_1-BL_s of the backlight module 240 corresponding to the display panel 210. The dimming circuit 232 is an integrated circuit having an operation function for adjusting the brightness of the backlight sources BL_1-BL_s according to the light distribution information. In specifics, according to the light contribution ratios corresponding to the different positions of the backlight sources BL_1-BL_s on the frame, the dimming circuit 232 may adjust the brightness provided by the backlight sources BL_1-BL_s, such that each point on the frame has sufficient backlight brightness.

Figure 3:
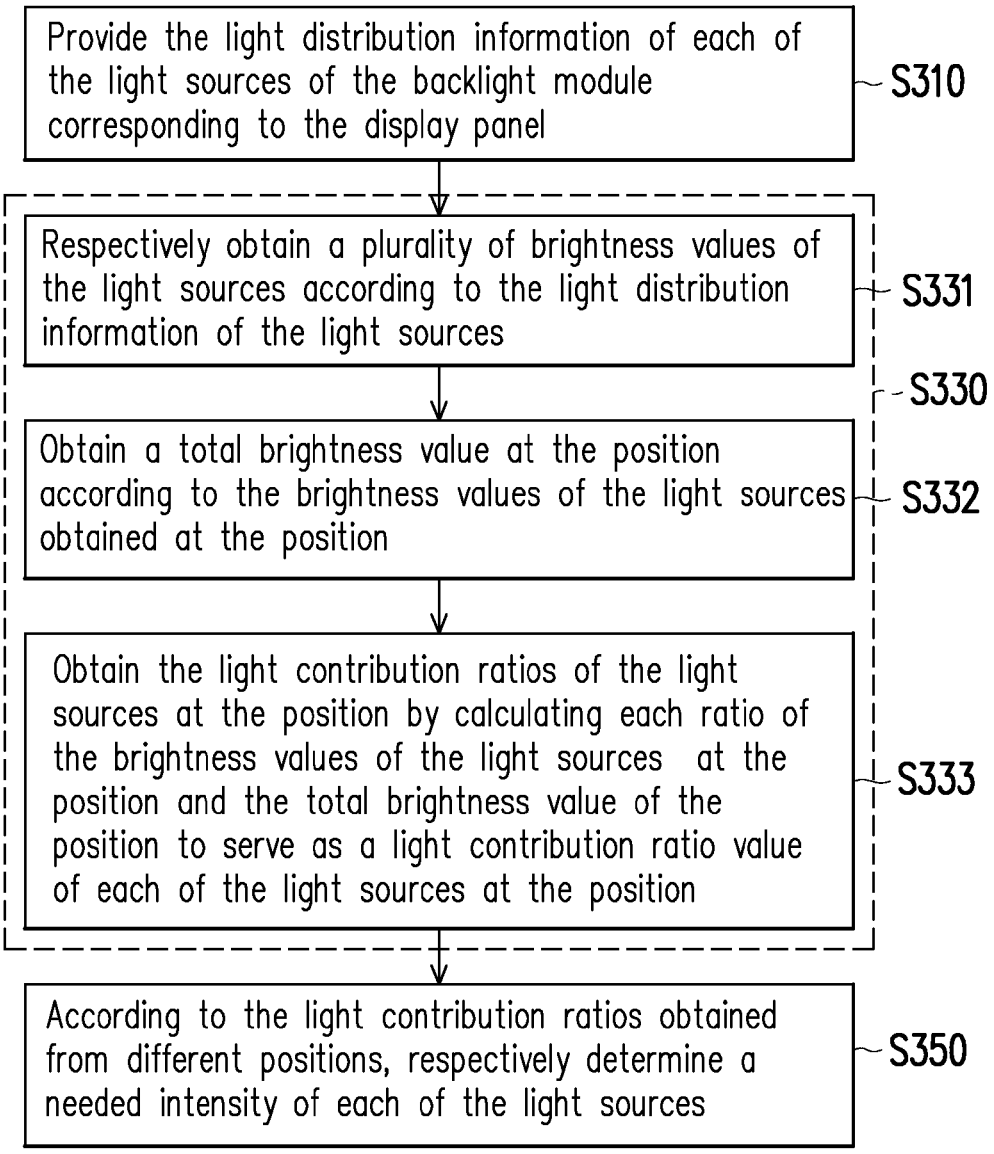
FIG. 3 is a flow diagram of a dimming method for a backlight module according to an embodiment of the invention.

To further describe the invention, FIG. 3 is a flow diagram of a dimming method for a backlight module according to an embodiment of the invention. With reference to FIGS. 2 and 3, the method described in the present embodiment may be adapted for the aforementioned LCD 20. The steps of the dimming method in the present embodiment are described in detail with reference to each element of the LCD 20.

Figure 4A:
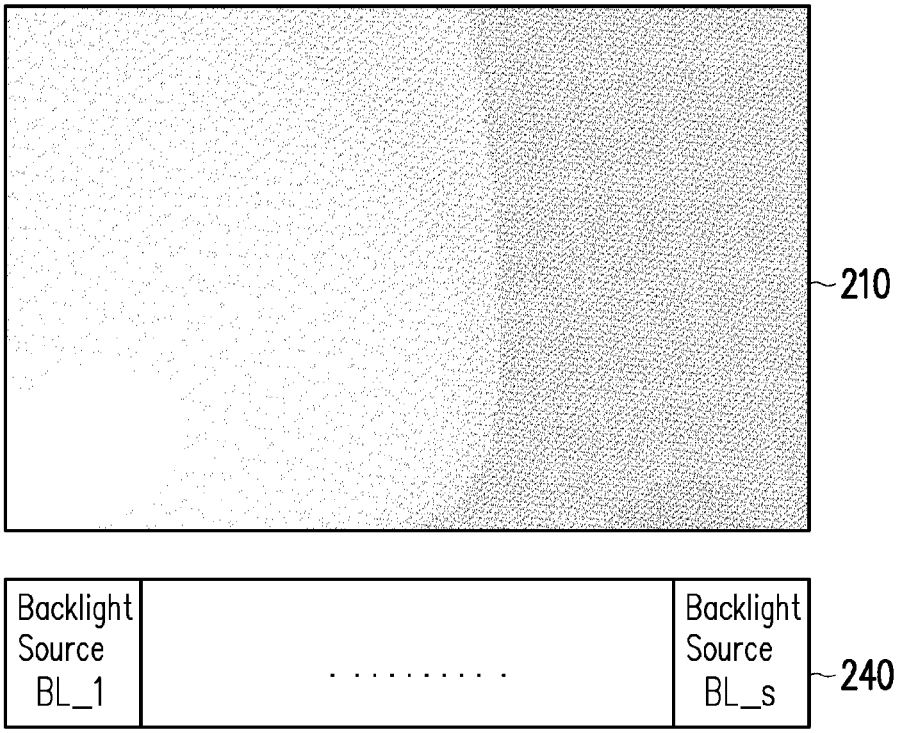
FIGS. 4A and 4B are schematic views of light profiles.
Figure 4B:
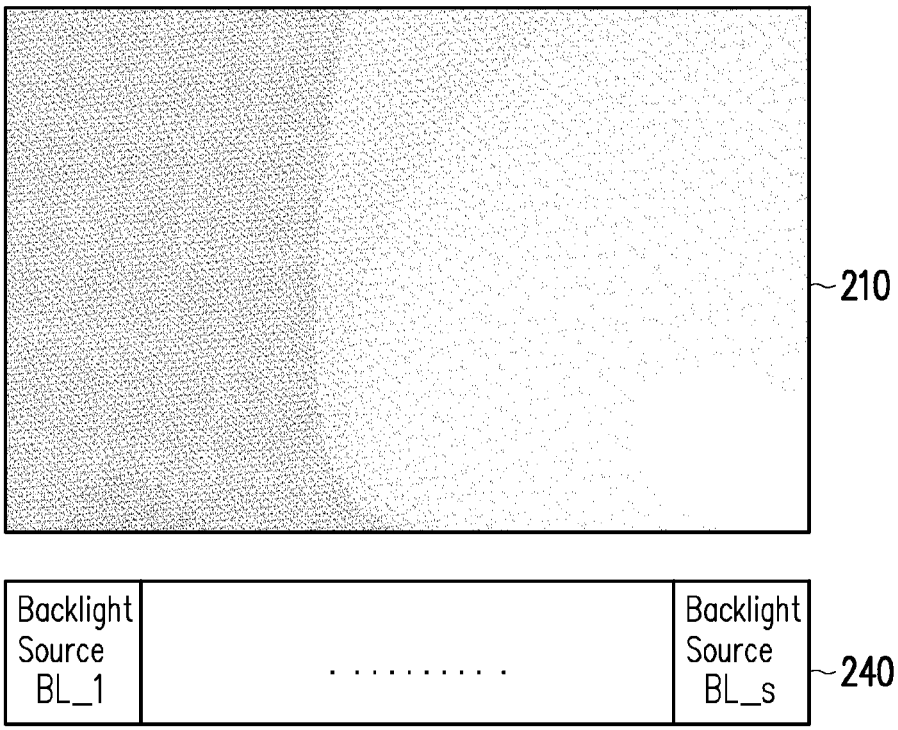

In Step S310, the database 231 provides the light distribution information of each of the backlight sources BL_1-BL_s of the backlight module 240 corresponding to the display panel 210. The light distribution information may be information obtained from the respective light profiles of the backlight sources BL_1-BL_s. In specifics, the light profiles are data of the respective light shape (light field distribution) of the backlight sources BL_1-BL_s on the display panel 210. Typically, the light profile of a single backlight source is obtained by lighting the single backlight source, and detecting/sampling the brightness of the single backlight source corresponding to different positions on the display panel 210. FIGS. 4A and 4B are schematic views of light profiles. When only the backlight source BL_1 is lighted, the light regions provided by the backlight source BL_1 on the display panel 210 are as shown in FIG. 4A. When only the backlight source BL_s is lighted, the light regions provided by the backlight source BL_s on the display panel 210 are as shown in FIG. 4B. In other words, each backlight source has its own corresponding light profile. Therefore, the database 231 may record the light distribution information of the light profile of each of the backlight sources BL_1-BL_s in the backlight module 240.

In the present embodiment, according to the light profile of each backlight source, the light distribution information of each of the backlight sources BL_1-BL_s may be the brightness values contributed by the backlight sources BL_1-BL_s at each of the pixels of the display panel 210. For example, the light distribution information of the backlight source BL_1 includes the brightness values contributed by the backlight source BL_1 at each of the pixels of the display panel 210. In brief, when each of the backlight sources is respectively lighted, the brightness values of all of the pixels $P_{11}$-$P_{mn}$ when each of the backlight sources is lighted are recorded, thereby respectively obtaining the brightness values of all of the pixels $P_{11}$-$P_{mn}$ of the backlight sources BL_1-BL_s. Moreover, the brightness values serve as the light distribution data and are stored in the database 231. It should be noted that, in the steps for obtaining the light profiles according to other embodiments, whether sub-sampling is used to reduce the data volume may be determined in accordance to the actual applications. That is, the light distribution information of each of the backlight sources BL_1-BL_s may also be the brightness values contributed by the backlight sources BL_1-BL_s at a portion of the pixels of the display panel 210, although the invention is not limited thereto.

Thereafter, in Step S330, according to the respective light distribution information of the backlight sources BL_1-BL_s, the dimming circuit 232 respectively obtains a plurality of light contribution ratios of the backlight sources BL_1-BL_s corresponding to a plurality of different positions of the display panel 210. In the present embodiment, the different positions of the display panel 210 may be each of the pixels $P_{11}$-$P_{mn}$ of the display panel 210. In other embodiments, to reduce the data volume, the different positions of the display panel 210 may also be a specific portion of the pixels of the display panel 210, such as sampled pixels at a specific interval. In other words, the dimming circuit 232 may obtain the light contribution ratios of each of the pixels $P_{11}$-$P_{mn}$ according to the light distribution information recorded by the database 231, and the dimming circuit 232 may also obtain the light contribution ratios of a portion of the pixels through the light distribution information, although the invention is not limited thereto.

It should be noted that, in the afore-described steps of the dimming circuit 232 respectively obtaining the light contribution ratios of the backlight sources BL_1-BL_s, the dimming circuit 232 may respectively obtain the light contribution ratios of at least two selected light sources corresponding to the pixels in the backlight sources BL_1-BL_s, according to the light distribution information at each pixel. In other words, at different positions or at each pixel of the display panel 210, in order to obtain the light contribution ratios of the at least two selected light sources on one position or one pixel, the dimming circuit 232 requires the light distribution information of the at least two selected light sources. In some embodiments, the at least two light sources corresponding to the pixel include all of the backlight sources in the backlight sources BL_1-BL_s.

However, the invention is not limited to obtaining the light contribution ratios of the backlight sources BL_1-BL_s by using all of the backlight sources BL_1-BL_s. In another embodiment, the at least two light sources corresponding to the pixel include at least two light sources in the backlight sources BL_1-BL_s nearest to the pixel. That is, for any selected pixel in the display panel 210, the backlight sources nearest in distance to the selected pixel serve the selected backlight sources. In specifics, according to the distances between each pixel and the backlight source, the backlight source nearest to the selected pixel is one of the selected backlight sources, and the backlight source that is second nearest to the selected pixel is another selected backlight source, and so on. As shown in FIG. 2, in some embodiments for the pixel P11, the at least two selected light sources may be the backlight source BL_1 and the backlight source BL_2 with the nearest distances. In other embodiments, the at least two selected light sources may also be the backlight source BL_1, the backlight source BL_2, and the backlight source BL_3 with the nearest distances.

Moreover, besides obtaining the light contribution ratios from the light distribution information of all of the light sources, and obtaining the light contribution ratios by using the light distribution information of the at least two light sources nearest to the pixel, in another embodiment of the invention, the at least two light sources may be selected by dividing the display panel 210 into different regions, such that the light distribution information of the at least two selected light sources are used to obtain the light contribution ratios. In specifics, the display panel 210 may be divided into a plurality of regions respectively corresponding to different light sources. The at least two selected light sources corresponding to the pixel include the light sources corresponding to the region where the pixel is located, and at least one light source corresponding to at least one adjacent region of the region where the pixel is located. In view of the above, according to different selection mechanisms, the dimming circuit 232 may select at least two light sources from all of the backlight sources BL_1-BL_s, and obtain the light contribution ratios of each pixel or on one position according to the light distribution information of the selected light sources.

Moreover, in the present embodiment, Step S330 for obtaining the light contribution ratios may be further divided into Steps S331-S333 for implementation. The dimming circuit 232 respectively performs Steps S331-S333 on each of the different positions of the display panel 210. Using the pixel $P_{11}$ of the display panel 210 as an illustrative example, in Step S331, the dimming circuit 232 respectively obtains a plurality of brightness values of the backlight sources BL_1-BL_s at the pixel $P_{11}$ of the display panel 210 according to the light distribution information corresponding to the backlight sources BL_1-BL_s. In Step S332, the dimming circuit 232 obtains a total brightness value at the pixel $P_{11}$ according to the brightness values of the light sources obtained at the pixel $P_{11}$. In light of the foregoing, after the dimming circuit 232 obtains the light profiles of each of the backlight sources BL_1-BL_s, the backlight of each point on the frame comes from a contribution sum of all of the backlight sources BL_1-BL_s.

Accordingly, in Step S333, the dimming circuit 232 obtains the light contribution ratios of the backlight sources BL_1-BL_s at the pixel $P_{11}$ by calculating each ratio of the brightness values of the backlight sources BL_1-BL_s at the pixel $P_{11}$ and the total brightness value of the pixel $P_{11}$ to serve as a light contribution ratio value of each of the backlight sources BL_1-BL_s at the pixel $P_{11}$. In other words, each respective light contribution ratio value is a ratio of each light source in the total brightness value. For example, assume an LCD has 4 backlight sources BL_1-BL_4. Moreover, on the pixel $P_{11}$ of the display panel 210, assume a brightness value contributed by the backlight source BL_1 is 512, a brightness value contributed by the backlight source BL_2 is 384, a brightness value contributed by the backlight source BL_3 is 96, a brightness value contributed by the backlight source BL_4 is 31, then a total brightness value is equaled to 512+354+96+31=1023. Furthermore, for the backlight sources BL_1-BL_4, each light contribution ratio on the pixel $P_{11}$ of the display panel 210 is 512/1023, 384/1023, 96/1023, and 31/1023. The light contribution ratios of the backlight sources BL_1-BL_s at the pixel $P_{11}$ are 512/1023:384/1023:96/1023:31/1023. However, the foregoing description are merely illustrative embodiments and should not be construed as limiting the spirit of the invention.

Thereafter, in Step S350, according to the light contribution ratios obtained from different positions, the dimming circuit 232 respectively determines a needed intensity of each of the backlight sources BL_1-BL_s. Therefore, the dimming methods in embodiments of the invention are no longer limited to the zone dimming techniques, but rather the backlight sources are adjusted/driven according directly to the actual backlight distribution, thereby ensuring each pixel has sufficient backlight brightness.

Figure 5:
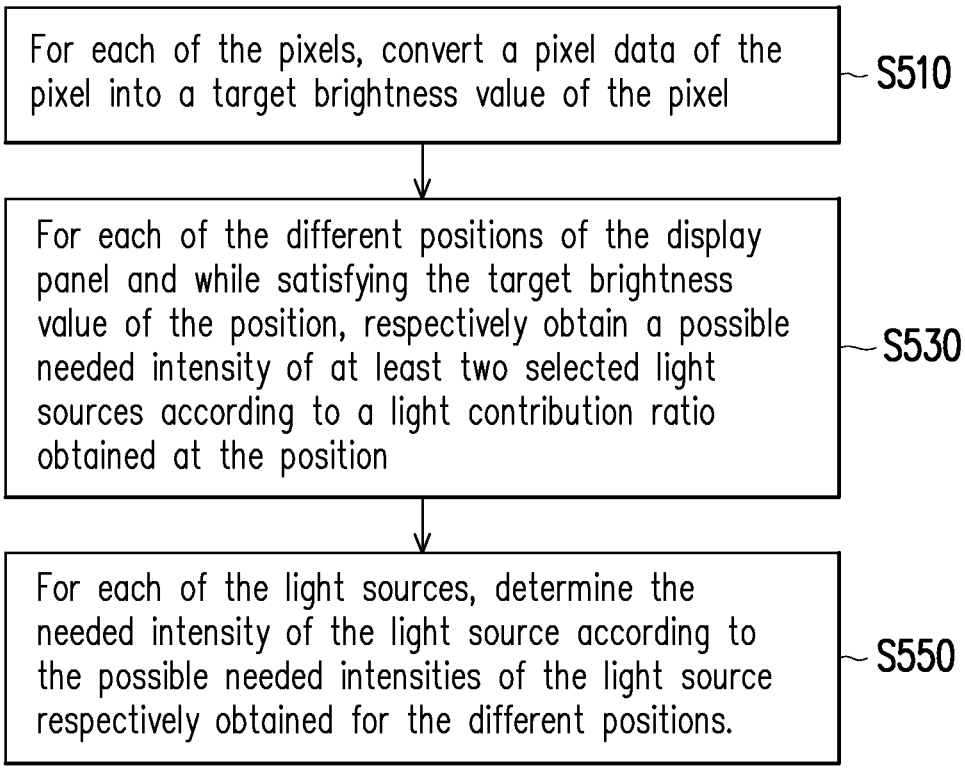
FIG. 5 is a detailed flow diagram of Step S350 in FIG. 3 according to an embodiment of the invention.

The foregoing embodiments illustrate in detail how light distribution information is used to calculate the light contribution ratios of each light source on a pixel, and the following description further elaborate on Step S350 with regards to how the dimming circuit 232 respectively determines the needed intensity of each light source by using the light contribution ratios. FIG. 5 is a detailed flow diagram of Step S350 in FIG. 3 according to an embodiment of the invention. With reference to FIGS. 2 and 5, the method described in the present embodiment may be adapted for the aforementioned LCD 20. The steps of the dimming method in the present embodiment are described in detail with reference to each element of the LCD 20.

In order to facilitate description of the invention, in the present embodiment, assume s=3. That is, the backlight module 240 of the LCD 20 has 3 backlight sources BL_1-BL_3. Moreover, when implementing the embodied methods on each pixel, further assume the light contribution ratio values calculated for each of the light sources BL_1-BL_3 is α, β, and γ, and the light contribution ratios of the backlight sources BL_1-BL_3 at the pixel is α:β:γ. α, β, and γ are less than or equal to 1, and α+β+γ=1.

In Step S510, for each of the pixels $P_{11}$-$P_{mn}$, the dimming circuit 232 converts a pixel data of the pixel provided by the display module 220 into a target brightness value k of the pixel. In brief, for the LCD 20 to display a frame, the display module 220 provides the pixel data of each pixel to drive the display panel 210 to display the frame. In the invention, the display module 220 may also provide the pixel data of each pixel to the dimming circuit 232, such that the dimming circuit 232 accordingly adjusts the light source brightness provided by the backlight module 240. In some embodiments, the dimming circuit 232 may convert the pixel data of the pixels $P_{11}$-$P_{mn}$ in Step S510 to the target brightness value k by using a GAMMA curve, although the invention is not limited thereto. In other embodiments, Step S510 may also include calculating the target brightness value k=DP/DM, in which DP is the pixel data of the pixel, and DM is a maximum value of a range of the pixel data. For example, assume the maximum value DM of the range of the pixel data is 256, and the pixel data DP of a certain pixel in an image is 128, then the target brightness value k of the pixel is 128/256=0.5.

Thereafter, in Step S530, for each of the different positions of the display panel 210 and while satisfying the target brightness value k of the position, the dimming circuit 232 respectively obtains a possible needed intensity of at least two selected light sources according to a light contribution ratio α:β:γ obtained at the position. In the present embodiment, for all of the pixels $P_{11}$-$P_{mn}$ on the display panel 210, the dimming circuit 232 may obtain the possible needed intensities of the backlight sources BL_1-BL_3 according to the light contribution ratio α:β:γ obtained on each pixel, while satisfying the target brightness value k of each pixel. For the backlight source BL_1 as an example, the dimming circuit 232 may obtain the possible needed intensity of the backlight source BL_1 according to the light contribution ratio α:β:γ obtained on the pixel $P_{11}$. The dimming circuit 232 may also obtain the possible needed intensity of the backlight source BL_1 according to the light contribution ratio α:β:γ obtained on the pixel $P_{12}$. By analogy, for the backlight source BL_1, m*n possible needed intensities corresponding to the pixels $P_{11}$-$P_{mn}$ may be obtained according to the light contribution ratios α:β:γ obtained on all of the pixels $P_{11}$-$P_{mn}$.

Moreover, according to embodiments of the invention, the methods of obtaining the possible needed intensities of the light sources according to the light contribution ratios α:β:γ may be divided into global-oriented methods and local-oriented methods, and each type is described in detail hereafter. It should be first noted that, assume L1-L3 are the backlight intensities when the duty cycle of the backlight sources BL_1-BL_3 is 100%, and for each pixel on the display panel 210, $\alpha L_1+\beta L_2+\gamma L_3=1$ represents the brightest state of the pixel.

Firstly, the dimming circuit 232 arranges the target brightness value to be equal to a sum of a product corresponding to the possible needed brightness of at least two selected backlight sources BL_1-BL_3 at the position and each light contribution ratio value, so as to calculate the possible needed brightness of the at least two selected light sources at the position. The equations are derived as follows:

$$k(\alpha L_1+\beta L_2+\gamma L_3)=k \quad (1)$$

$$\alpha(kL_1)+\beta(kL_2)+\gamma(kL_3)=k \quad (2)$$

In the present embodiment, as shown in equation (2), the dimming circuit 232 arranges the target brightness value k to be equal to a sum of a product corresponding to the possible needed brightness $kL_1$, $kL_2$, and $kL_3$ of the backlight sources BL_1-BL_3 at each pixel $P_{11}$-$P_{mn}$ and each light contribution ratio value α, β, and γ.

Thereafter, in the global-oriented methods, the dimming circuit 232 arranges the possible needed intensities of the at least two selected backlight sources BL_1-BL_3 to be equal, for each of the different positions of the display panel 210. For the pixel $P_{11}$ of the display panel 210 as an example, the dimming circuit 232 may arrange the possible needed intensities of the selected backlight sources BL_1-BL_3 to be equal, such that a brightness contribution sum of the backlight sources BL_1-BL_3 for the pixel $P_{11}$ may satisfy the target brightness value k of the pixel $P_{11}$. In other words, the dimming circuit 232 examines the needed backlight intensity of each of the pixels $P_{11}$-$P_{mn}$ and evenly distributes the needed backlight intensity among the backlight sources BL_1-BL_3. Each of the backlight sources BL_1-BL_3 has its own brightness contribution to each of the pixels $P_{11}$-$P_{mn}$.

Moreover, for each of the different positions of the display panel 210, the dimming circuit 232 may also arrange to 0 the possible needed intensity of the selected light source in the at least two selected backlight sources BL_1-BL_3 having the respective brightness contribution ratio values α, β, and γ less than a threshold value, and the dimming circuit 232 may arrange the possible needed intensities of the other selected light sources in the at least two selected backlight sources BL_1-BL_3 to be equal. In brief, the dimming circuit 232 sets a brightness contribution threshold value. For the pixel $P_{11}$ of the display panel 210 as an example, assume the respective brightness contribution value γ of the backlight source BL_3 corresponding to the pixel $P_{11}$ has not reached the brightness contribution threshold value, and the respective brightness contribution values α and β of the other backlight sources BL_1-BL_2 corresponding to the pixel $P_{11}$ are greater than the threshold value, then the dimming circuit 232 may arrange the possible needed intensity of the backlight source BL_3 corresponding to the pixel $P_{11}$ to 0. Moreover, the brightness contributions of the other backlight sources BL_1-BL_2 are increased to compensate, such that the brightness contribution sum of the backlight sources BL_1-BL_2 corresponding to the pixel $P_{11}$ may satisfy the target brightness value k of the pixel $P_{11}$. The calculation of the possible needed intensities of the backlight sources BL_1-BL_3 at other positions/pixels of the display panel 210 may be derived by analogy. The foregoing embodiments have clearly described the various mechanisms to choose the selected light sources. In view of the above, the selected light sources in the present embodiment may be all of the backlight sources BL_1-BL_3, although the invention is not limited thereto. Therefore, after the dimming circuit 232 chooses the selected backlight sources BL_1-BL_3, the threshold value is used to exclude the light sources with low brightness contribution.

On the other hand, in the local-oriented methods, the dimming circuit 232 determines a ratio of the possible needed intensities of the at least two selected backlight sources according to the brightness contribution ratio α:β:γ of the at least two selected backlight sources BL_1-BL_3, for each of the different positions of the display panel 210. In specifics, for example, the dimming circuit 232 may set the ratio of the possible needed intensities of the at least two selected backlight sources BL_1-BL_3 to be equal to the brightness contribution ratio α:β:γ of the selected backlight sources BL_1-BL_3. The equation is derived as follows:

$$L_1 : L_2 : L_3 = \alpha : \beta : \gamma = \frac{\alpha}{\gamma} : \frac{\beta}{\gamma} : \frac{\gamma}{\gamma} \tag{3}$$

Based on equations (2) and (3), it may be derived that:

$$\frac{\alpha^2}{\gamma}(kL_3) + \frac{\beta^2}{\gamma}(kL_3) + \frac{\gamma^2}{\gamma}(kL_3) = k \tag{4}$$

$$L_3 = \frac{\gamma}{\alpha^2 + \beta^2 + \gamma^2},\ L_1 = \frac{\alpha}{\alpha^2 + \beta^2 + \gamma^2},\ L_2 = \frac{\beta}{\alpha^2 + \beta^2 + \gamma^2} \tag{5}$$

In other words, the dimming circuit 232 arranges the possible needed brightness of each light source according to the brightness contribution ratio of each of the backlight sources BL_1-BL_3 on each pixel. Therefore, every examination of a pixel obtains a new set of backlight ratio (ratio of possible needed intensities). In Step S550, for each of the backlight sources BL_1-BL_3, the dimming circuit 232 determines the needed intensities of the backlight sources BL_1-BL-3 according to the possible needed intensities of the backlight sources BL_1-BL_3 respectively obtained for the different positions. In the present embodiment, for each of the backlight sources BL_1-BL_3, the dimming circuit 232 determines the needed intensities of the backlight sources BL_1-BL-3 according to a maximum of the possible needed intensities of the backlight sources BL_1-BL_3 respectively obtained for the different positions.

For example, assume the dimming circuit 232 only considers 4 positions (e.g., pixel $P_{11}$, pixel $P_{1n}$, pixel $P_{m1}$, and $P_{mn}$) of the display panel 210. Moreover, assuming in Step S530 the possible needed intensities of the backlight source BL_1 obtained by the dimming circuit 232 at the pixel $P_{11}$, the pixel $P_{1n}$, the pixel $P_{m1}$, and the $P_{mn}$ are respectively $L1_{11}$, $L1_{1n}$, $L1_{m1}$, and $L1_{mn}$, then in Step S550 the dimming circuit 232 may find the maximum of the possible needed intensities $L1_{11}$, $L1_{1n}$, $L1_{m1}$, and $L1_{mn}$, to serve as the needed intensity of the backlight source BL_1. Similarly, assuming in Step S530 the possible needed intensities of the backlight source BL_2 obtained by the dimming circuit 232 at the pixel $P_{11}$, the pixel $P_{1n}$, the pixel $P_{m1}$, and the $P_{mn}$ are respectively $L2_{11}$, $L2_{1n}$, $L2_{m1}$, and $L2_{mn}$, then in Step S550 the dimming circuit 232 may find the maximum of the possible needed intensities $L2_{11}$, $L2_{1n}$, $L2_{m1}$, and $L2_{mn}$, to serve as the needed intensity of the backlight source BL_2.

In other words, each of the backlight sources BL_1-BL_3 has different possible needed light source intensities on each position of the pixels $P_{11}$-$P_{mn}$. The dimming circuit 232 looks for a maximum value among the different possible needed light source intensities, to serve as a maximum needed intensity of each of the backlight sources BL_1-BL_3.

In view of the foregoing, in the dimming methods and dimming devices according to embodiments of the invention, the light intensity of each light source is adjusted in accordance with the light distribution information of each light source. Therefore, the dimming methods are no longer limited to the zone dimming techniques, but rather the backlight sources are driven according directly to the actual backlight distribution, thereby ensuring each pixel has sufficient backlight brightness to accurately display the pixel contents of each pixel. Moreover, since embodiments of the invention drive the backlight source according to the actual backlight distribution, more freedom may be afforded to the design of the light guide plate. Accordingly, insufficient brightness for some display zones due to uneven light guidance from the light guide plate is prevented, thereby enhancing the display quality of the edge-type LCD.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A dimming method for a backlight module, comprising:

according to a plurality of light distribution information of a plurality of light sources of the backlight module which are corresponding to each of different positions of the display panel, respectively obtaining a plurality of light contribution ratios of the light sources corresponding to the different positions of the display panel; and according to the light contribution ratios corresponding to the different positions, respectively determining a needed intensity of each of the light sources, wherein, the step of determining the needed intensity of each of the light sources comprises:

(i) for each of the different positions of the display panel and while satisfying a target brightness value of the position, respectively obtaining possible needed intensities of at least two selected light sources according to the light contribution ratio obtained at the position; and (ii) for each of the light sources, determining the needed intensity of the light source according to the possible needed intensities of the light source respectively obtained for the different positions.

2. The dimming method for the backlight module according to claim 1, wherein the light distribution information of each of the light sources comprises a brightness value contributed by the light source at each of the pixels of the display panel.

3. The dimming method for the backlight module according to claim 1, wherein the different positions of the display panel comprise each of the pixels of the display panel.

4. The dimming method for the backlight module according to claim 1, wherein the step of respectively obtaining the light contribution ratios of the light sources comprises: for each pixel, respectively obtaining the light contribution ratio of at least two selected light sources corresponding to the pixel in the backlight module.

5. The dimming method for the backlight module according to claim 4, wherein the at least two selected light sources corresponding to the pixel comprise all of the light sources in the backlight module.

6. The dimming method for the backlight module according to claim 4, wherein the at least two selected light sources corresponding to the pixel comprise at least two light sources nearest to the pixel in the backlight module.

7. The dimming method for the backlight module according to claim 4, wherein the display panel is divided into a plurality of regions respectively corresponding to all of the light sources in the backlight module, and the at least two selected light sources corresponding to the pixel comprise a light source corresponding to a region where the pixel is located, and at least one light source corresponding to at least one region adjacent to the region where the pixel is located.

8. The dimming method for the backlight module according to claim 1, wherein the step of according to the light distribution information of the light sources of the backlight module which are corresponding to each of different positions of the display panel, respectively obtaining the light contribution ratios of the light sources corresponding to the different positions of the display panel comprises:

respectively performing the following steps at each of the different positions of the display panel:

according to the light distribution information of each of the light sources, respectively obtaining a plurality of brightness values of the light sources;

according to the brightness values of the light sources obtained at the position, obtaining a total brightness value at the position; and obtaining the light contribution ratios of the light sources at the position by respectively calculating each ratio of the brightness values of the light sources at the position and the total brightness value to serve as a light contribution ratio value of each of the light sources at the position.

9. The dimming method for the backlight module according to claim 1, further comprising:

for each of the pixels, converting a pixel data of the pixel into the target brightness value of the pixel.

10. The dimming method for the backlight module according to claim 9, wherein the step of converting the pixel data of the pixel into the target brightness value is implemented by using a GAMMA curve.

11. The dimming method for the backlight module according to claim 9, wherein the step of converting the pixel data of the pixel into the target brightness value comprises:

calculating k=DP/DM, wherein k is the target brightness value of the pixel, DP is the pixel data of the pixel, and DM is a maximum value of a range of the pixel data.

12. The dimming method for the backlight module according to claim 1, wherein the step of respectively obtaining the possible needed intensity of the at least two selected light sources according to the light contribution ratio obtained at the position comprises:

arranging the target brightness value to be equal to a sum of a product corresponding to the possible needed brightness of the at least two selected light sources at the position and each light contribution ratio value, so as to calculate the possible needed brightness of the at least two selected light sources at the position.

13. The dimming method for the backlight module according to claim 1, wherein the step (i) further comprises: for each of the different positions of the display panel, setting the possible needed intensities of the at least two selected light sources to be equal.

14. The dimming method for the backlight module according to claim 1, wherein the step (i) further comprises:

for each of the different positions of the display panel, arranging to 0 the possible needed intensity of the selected light source in the at least two selected light sources having a brightness contribution ratio value less than a threshold value, and arranging the possible needed intensities of the other selected light sources in the at least two selected light sources to be equal.

15. The dimming method for the backlight module according to claim 1, wherein the step (i) further comprises: for each of the different positions of the display panel, determining a ratio of the possible needed intensities of the at least two selected light sources according to the light contribution ratio of the at least two selected light sources.

16. The dimming method for the backlight module according to claim 15, wherein the step of determining the ratio of the possible needed intensities of the at least two selected light sources according to the light contribution ratio of the at least two selected light sources comprises: determining the ratio of the possible needed intensities of the at least two selected light sources to be equal to the light contribution ratio of the at least two selected light sources.

17. The dimming method for the backlight module according to claim 1, wherein the step (ii) of determining the brightness of the light sources comprises:

for each of the light sources, determining a maximum of the possible needed intensities of the light source respectively obtained for the different positions to serve as the needed intensity of the light source.

18. A dimming method for a backlight module, comprising:

providing a light distribution information of a plurality of light sources of the backlight module corresponding to a display panel;

at each of a plurality of pixels of the display panel, respectively obtaining a light contribution ratio of at least two selected light sources in the plurality of light sources according to the light distribution information of the at least two selected light sources corresponding to the pixel;

for each of the different positions of the display panel and while satisfying a target brightness value of the position, respectively obtaining a possible needed intensity of the at least two selected light sources according to the light contribution ratio obtained at the position; and for each of the light sources, determining a needed intensity of the light source according to the possible needed intensities of the light source respectively obtained for the different positions.

19. The dimming method for the backlight module according to claim 18, wherein the at least two selected light sources corresponding to the pixel comprise all or part of the light sources in the backlight module.

20. A dimming device for a backlight module, comprising:

a database providing a plurality of light distribution information of a plurality of light sources of the backlight module corresponding to a display panel; and a dimming circuit coupled to the database, wherein according to the plurality of light distribution information of the light sources which are corresponding to each of different positions of the display panel, the dimming circuit respectively obtains a plurality of light contribution ratios of the light sources corresponding to the different positions of the display panel, and according to the light contribution ratios corresponding to the different positions, the dimming circuit respectively determines a needed intensity of each of the light sources, wherein for each of the different positions of the display panel and while satisfying a target brightness value of the position, the dimming device respectively obtains possible needed intensities of at least two selected light sources in the light sources according to the light contribution ratio obtained at the position; and for each of the light sources, the dimming circuit determines the needed intensity of the light source according to the possible needed intensities of the light source respectively obtained for the different positions.

21. The dimming device for the backlight module according to claim 20, wherein the light distribution information of each of the light sources comprises a brightness value contributed by the light source at each of the pixels of the display panel.

22. The dimming device for the backlight module according to claim 20, wherein the different positions of the display panel comprise each of the pixels of the display panel.

23. The dimming device for the backlight module according to claim 20, wherein for each of the pixels, the dimming circuit respectfully obtains the light contribution ratio of at least two selected light sources corresponding to the pixel in the backlight module.

24. The dimming device for the backlight module according to claim 23, wherein the at least two selected light sources corresponding to the pixel comprise all of the light sources in the backlight module.

25. The dimming device for the backlight module according to claim 23, wherein the at least two selected light sources corresponding to the pixel comprise at least two light sources nearest to the pixel in the backlight module.

26. The dimming device for the backlight module according to claim 23, wherein the display panel is divided into a plurality of regions respectively corresponding to all of the light sources in the backlight module, and the at least two selected light sources corresponding to the pixel comprise a light source corresponding to a region where the pixel is located, and at least one light source of at least one region adjacent to the region where the pixel is located.

27. The dimming device for the backlight module according to claim 20, wherein for each of the different positions of the display panel, the dimming circuit respectively performs the following steps: according to the light distribution information of each of the light sources, respectively obtaining a plurality of brightness values of the light sources; according to the brightness values of the light sources obtained at the position, obtaining a total brightness value at the position; and obtaining the light contribution ratios of the light sources at the position by respectively calculating each ratio of the brightness values of the light sources at the position and the total brightness value to serve as a light contribution ratio value of each of the light sources at the position.

28. The dimming device for the backlight module according to claim 20, wherein for each of the pixels, the dimming circuit converts a pixel data of the pixel into the target brightness value of the pixel.

29. The dimming device for the backlight module according to claim 28, wherein the dimming circuit converts the pixel data of the pixel into the target brightness value by using a GAMMA curve.

30. The dimming device for the backlight module according to claim 28, wherein the dimming circuit calculates k=DP/DM, wherein k is the target brightness value of the pixel, DP is the pixel data of the pixel, and DM is a maximum value of a range of the pixel data.

31. The dimming device for the backlight module according to claim 20, wherein the dimming circuit arranges the target brightness value to be equal to a sum of a product corresponding to the possible needed brightness of the at least two selected light sources at the position and each light contribution ratio value, so as to calculate the possible needed brightness of the at least two selected light sources at the position.

32. The dimming circuit for the backlight module according to claim 20, wherein for each of the different positions of the display panel, the dimming circuit arranges the possible needed intensities of the at least two selected light sources to be equal.

33. The dimming circuit for the backlight module according to claim 20, wherein for each of the different positions of the display panel, the dimming circuit arranges to 0 the possible needed intensity of the selected light source in the at least two selected light sources having a brightness contribution ratio value less than a threshold value, and the dimming circuit arranges the possible needed intensities of the other selected light sources in the at least two selected light sources to be equal.

34. The dimming device for the backlight module according to claim 20, wherein for each of the different positions of the display panel, the dimming circuit determines a ratio of the possible needed intensities of the at least two selected light sources according to the light contribution ratio of the at least two selected light sources.

35. The dimming device for the backlight module according to claim 34, wherein the dimming circuit determining the ratio of the possible needed intensities of the at least two selected light sources to be equal to the light contribution ratio of the at least two selected light sources.

36. The dimming device for the backlight module according to claim 20, wherein for each of the light sources, the dimming circuit determines a maximum of the possible needed intensities of the light source respectively obtained for the different positions to serve as the needed intensity of the light source.

37. A dimming device for a backlight module, comprising:

a database providing a light distribution information of a plurality of light sources of the backlight module corresponding to a display panel;

a dimming circuit coupled to the database, wherein at each of a plurality of pixels of the display panel, the dimming circuit respectively obtains a light contribution ratio of at least two selected light sources in the plurality of light sources according to the light distribution information of the at least two selected light sources corresponding to the pixel; for each of the different positions of the display panel and while satisfying a target brightness value of the position, the dimming circuit respectively obtains a possible needed intensity of the at least two selected light sources according to the light contribution ratio obtained at the position; and for each of the light sources, the dimming circuit determines a needed intensity of the light source according to the possible needed intensities of the light source respectively obtained for the different positions.

38. The dimming device for the backlight module according to claim 37, wherein the at least two selected light sources corresponding to the pixel comprise all or part of the light sources in the backlight module.

* * * * *